US006816692B1

(12) United States Patent
Kerley et al.

(10) Patent No.: US 6,816,692 B1
(45) Date of Patent: Nov. 9, 2004

(54) SUPPORT ASSEMBLY FOR ROLLER INCLUDING ROLLER BODY AND SUPPORT SHAFT

(75) Inventors: Matthew Thomas Kerley, Lexington, KY (US); Benjamin Keith Newman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/442,816

(22) Filed: May 21, 2003

(51) Int. Cl.[7] ..... G03G 15/00
(52) U.S. Cl. ..... 399/222; 399/119
(58) Field of Search ..... 399/222, 119, 399/120, 279, 313, 328, 110

(56) References Cited

U.S. PATENT DOCUMENTS 3,667,310 A 6/1972 Hahner
6,530,692 B2 * 3/2003 Wyer ..... 384/295
6,654,583 B2 * 11/2003 Suzuki et al. ..... 399/281

FOREIGN PATENT DOCUMENTS

JP 05134573 A * 5/1993 ..... G03G/15/20

* cited by examiner

*Primary Examiner*—Quana Grainger
(74) *Attorney, Agent, or Firm*—John A. Brady

(57) ABSTRACT

Gear (52) and resin body (2) supported on shaft (1) and between frame members (14*a*) and (14*b*) are protected from contacting a frame member. Frame (14*a*) has a partial hole (22) with an opening (24) and a cavity (26), which is open at the hole (22) and on the side toward the opening (24). A bearing (18) has a inner body (30) which internally is partially circular with diameter substantially the same as opening (22). The outer portion of body (30) forms an outwardly extending nub (34). Wall (36) extends across body (30). The part (38) of bearing 18 opposite body 30 has an extended part (38*a*) to serve as an electrical contact. A shaft end (Sa) past a circular ledge (3*a*) is supported by bearing (18). The nub (34) fits in the cavity (26) and the wall (36) defines the proper position of rotation of the bearing. This protects gear (52) from being dislodged from its position on shaft (1). Where the resin body (2) is for electrophotographic developing, toner carried by the body (2) is not subject to effects from the body contacting a frame element or the like.

13 Claims, 6 Drawing Sheets

SUPPORT ASSEMBLY FOR ROLLER INCLUDING ROLLER BODY AND SUPPORT SHAFT

TECHNICAL FIELD

This invention relates to mounting rollers, such as electrophotographic developer rollers, to be protected from being damaged or deformed by lateral forces. Such forces may come from drive forces employing helical gears or from external impact such a being dropped.

BACKGROUND OF THE INVENTION

Rollers such as electrophotographic developer rollers are relatively pliable cylindrical masses mounted on a steel shaft. (The cylindrical mass will be termed here the "roller body.") The steel shaft is inherently resistant to deformation. Deformation of the roller body by lateral forces can cause the support frame to impact gears mounted on the shaft, which can destroy the gear operation. Additionally, deformation of the roller body by lateral forces results in uneven development and escape of toner out of the electrostatic device, both events being unacceptable.

Prior rollers are known which provide a circular ledge in the support shaft on each side of the support shaft. The roller body is located between the ledges. The ledges, as well as edges of the roller body contact the frame. This can be acceptable where the gear on the shaft is press fit and can be moved slightly when dropped, and where toner escape is prevented by the frame being sufficiently stiff.

A prior assembly for preventing lateral forces on the roller body is understood to provide a notch for a C clip spaced a short distance from the ledge at each ledge. The notches are positioned immediately past the frame holding the roller, so that the C clip in each notch prevents significant lateral movement by abutting the frame. (The frame at this location normally includes a bearing in which the shaft is inserted.) The shaft is held in one lateral direction by one of the C clips abutting the frame and the shaft is held in the other lateral direction by the other C clip abutting the frame.

Such an assembly, however, does not protect a gear mounted on the shaft when the frame deflects so much that a C clip is displaced. Similarly, such an assembly does not protect the roller body when the frame deflects so much that the roller body comes in contact with the frame or another element on the side of the assembly. Moreover, it is desirable to eliminate the C clips, as they are separate elements having some cost and some potential of failure and are difficult to repair.

DISCLOSURE OF THE INVENTION

In accordance with an implementation of this invention a ledge is provided on each side of the roller shaft. On one end of the shaft the ledge abuts the frame element to protect the roller body from lateral movement in one direction in the manner of the ledge in of the foregoing prior assembly. A unique, first bearing and frame combination is provided to receive the shaft on the other end of the shaft. The first bearing has a small width and a larger width, the larger width having an extended part. The frame has an opening to allow the bearing to enter when the small width faces the opening and has a cavity to receive a part of the larger width when the bearing is rotated. The cavity has an outer wall that is part of the frame.

The first bearing has a central hole in which the shaft is inserted. The opposite end of the shaft is inserted into a conventional, second bearing in the frame on the side opposite to the first bearing. The second bearing may be conventional when it is in a stiff element such as a gear plate. With the shaft inserted, the first bearing is rotated so that its small width fits into the frame opening and is then inserted into that frame opening. Then the first bearing is rotated so that the extended part is in the cavity of the frame.

In this assembly both sides of the shaft abut the bearings, which are part of the frame. Therefore, the roller body is prevented from coming in contact with the frame.

In an embodiment, the shaft carries a helical gear, which is positively attached to the shaft, specifically by a snap fit on the gear that mates with a notch fitted into a ledge in the shaft. This positions the gear against movement by lateral forces caused by the helical gear design, which permits the gear assembly to be compact and carry large forces. The gear is prevented from being stripped out of the notch when the cartridge is subjected to large lateral forces by the shaft being firmly positioned with respect to the frame.

The first bearing preferably is electrically conductive and has an extended part on its outside past the frame for contact with an electrical contact pad in a cartridge in which the roller is mounted.

BRIEF DESCRIPTION OF THE DRAWINGS

The details of this application will be described in connection with the accompanying drawings, in which.

DESCRIPTION OF THE PREFERRED EMBODIMENTS

Figure 1:
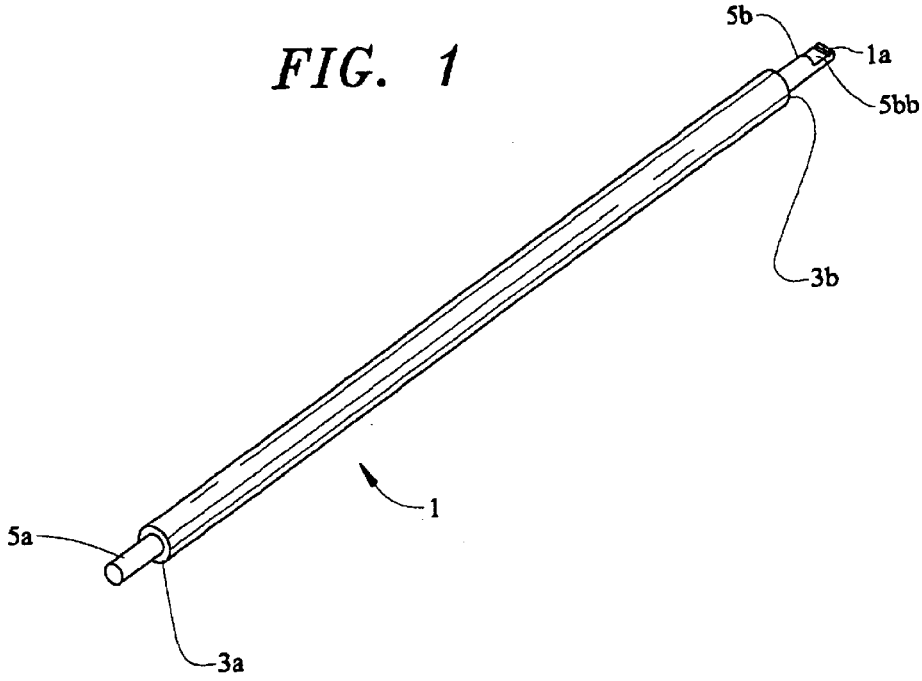
FIG. 1 is the central support shaft having circular ledges on each end.

FIG. 1 shows the steel shaft 1, which supports a roller body 2 (FIG. 7) disposed around shaft 1 to form a developer roller. Roller body 2 is a resilient, polymeric material for which it is an aspect of this invention that roller body 2 is protected from lateral forces.

Figure 8:
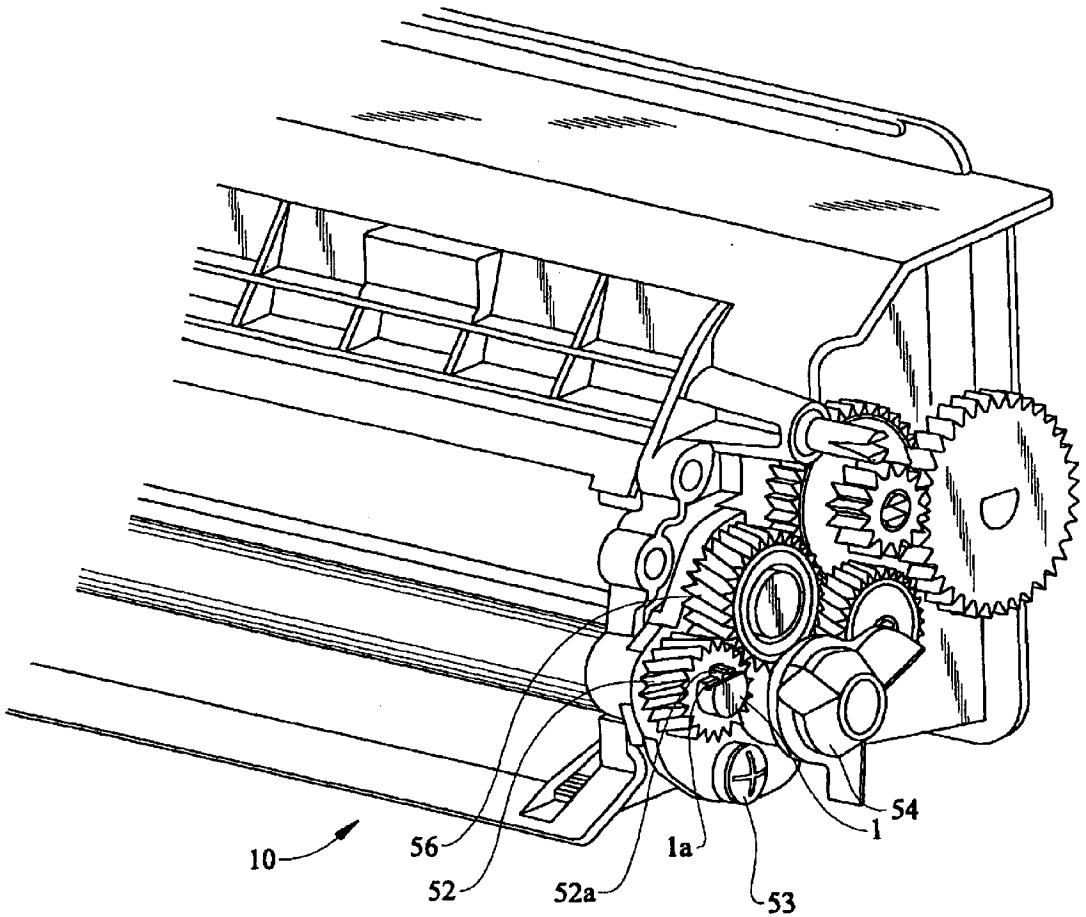
FIG. 8 illustrates the gear assembly, having a gear mounted on the shaft of the roller.

Shaft 1 has circular ledges 3*a*, 3*b* near each end of shaft 1 formed by the shaft being reduced to cylindrical end sections 5*a*, 5*b*. End section 5*b* has a flat end section 5*bb* to mesh with a gear 52 (FIG. 8). Shaft 1 differs from that of the prior assembly discussed in the foregoing essentially by having no notch for a C clip and by having a notch 1*a* for engagement with a drive gear snap.

Figure 2:
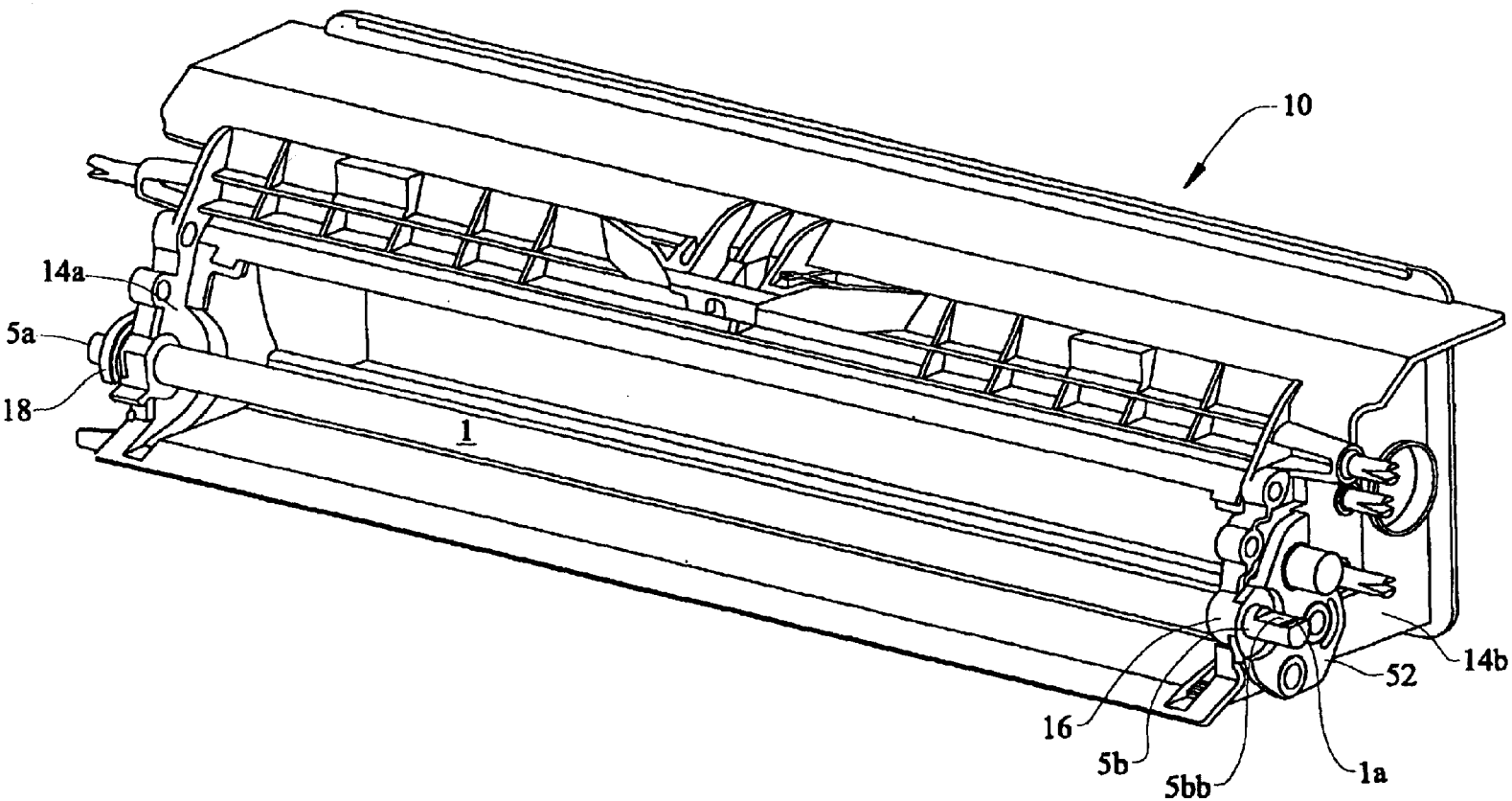
FIG. 2 is the mounting assembly of this invention in an electrostatic developer cartridge, with the roller body not shown so as to better illustrate of this invention.
Figure 7:
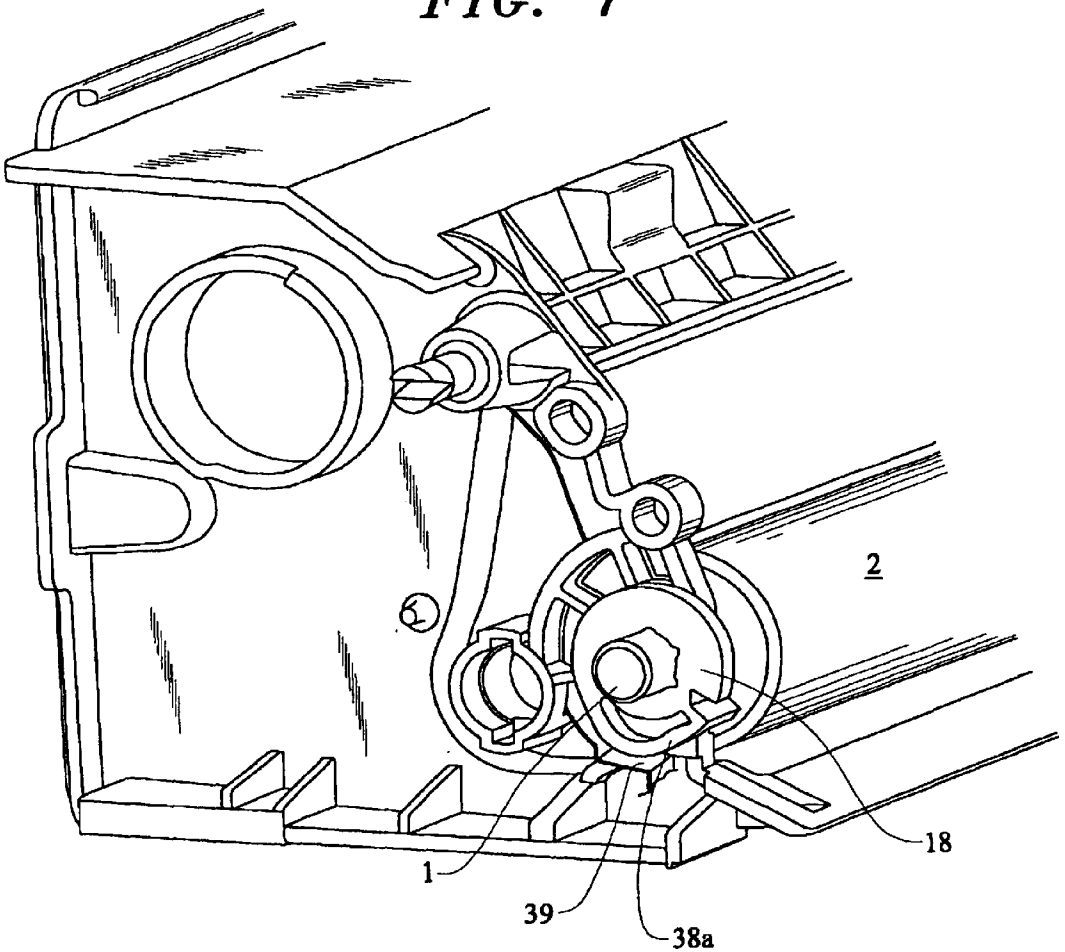
FIG. 7 shows the bearing installed from the outside of the developer cartridge and shows the roller body.

FIG. 2 shows the shaft alone installed in a toner cartridge 10. (The full developer roller with shaft 1 and roller body 2 is shown in FIG. 7). The cartridge 10 carries a supply of electrostatic toner powder that is supplied to the roller body 2 for application to a photoconductor drum (not shown). The opening 12 on the upper right is to support a bearing for a toner paddle. Such a system may be entirely conventional and therefore will not be discussed in detail.

Of direct interest with respect to this invention are the structural support elements of cartridge 10, including left wall 14*a* and right wall 14*b*, collectively known as the frame. Shaft is supported for rotation by right bearing 16, which is a round and cylindrical, and by left bearing 18, which is unique in accordance with this invention. Bearings 16 and 18 are held by side walls 14*b* and 14*a* respectively and therefore constitute part of the frame of cartridge 10. As is conventional, bearing 18 is a hard, smooth durable plastic, which provides a low-friction surface for shaft end 5*a* to be reliably positioned for rotation. Bearing 18 is a POM (polyoxymethylene) plastic carbon filled to be electrically conductive so as to provide an electrical potential to shaft 1 during use.

Figure 3:
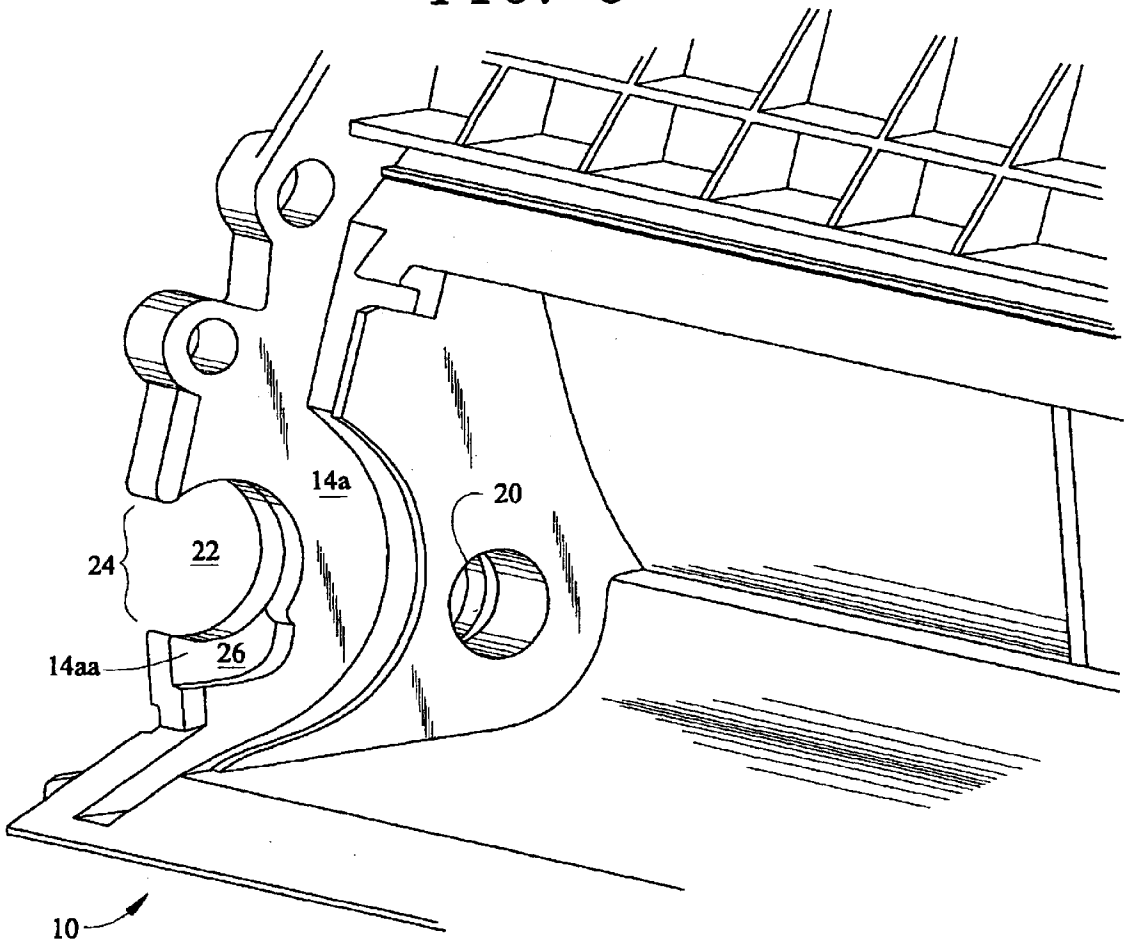
FIG. 3 is the unique frame configuration of this invention.
Figure 6:
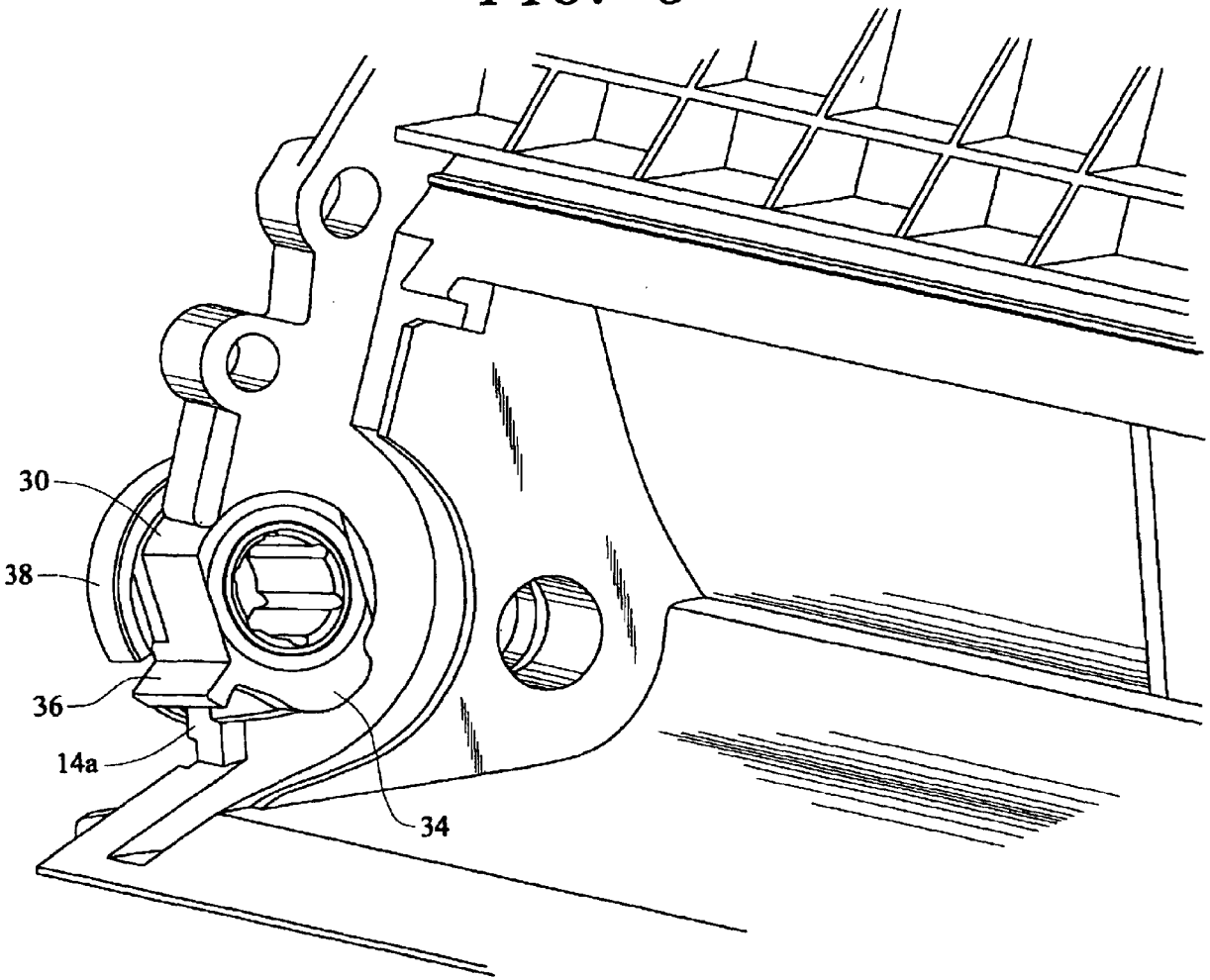
FIG. 6 shows the bearing installed from the inside of the developer cartridge.

FIG. 3 illustrates the left wall 14*a* and surrounding areas without the bearing 18. Hole 20 is to receive a bearing to support a standard toner adder roller, which will not be discussed in further detail. Of direct interest is opening 22 in wall 14*a* having a circular perimeter except for a gap 24, and adjoining a cavity 26. Cavity 26 has a bottom and back surface extending into cartridge 10, but is open on where it faces hole 22 and on the front side. Cavity 26 has an outer wall 14*aa* on the side toward hole 22.

Figure 4:
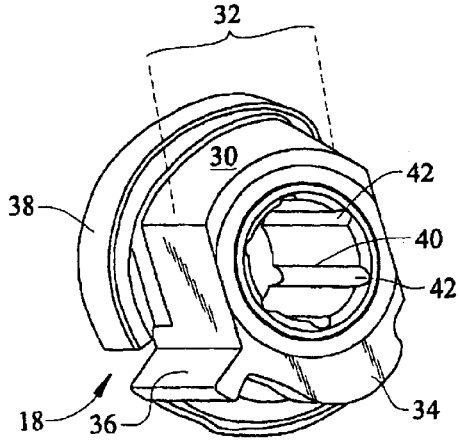
FIG. 4 is a perspective view of the bearing of this invention from the inside of the developer cartridge when installed.

FIG. 4 shows bearing 18 from the side facing the interior of cartridge 10 when bearing 18 is installed on cartridge 10. Bearing 18 has two flat sides extending across an inner body 30 defining a narrow dimension 32. Remaining internal portions of inner body 30 define a circular perimeter. Dimension 32 is substantially the same size (equal to or somewhat less in size) to the width of opening 24 in hole 22 (FIG. 3). The circular perimeter of inner body 30 is substantially equal in diameter to or slightly greater than the diameter of the central portion of hole 22.

An outer portion of inner body 30 is an outwardly extending nub 34 that conforms in size and outer contour to cavity 26 (FIG. 3). Nub 34 is located generally between the flat sides of inner body 30. Bearing 18 has a wall 36 extending across inner body 30.

Figure 5:
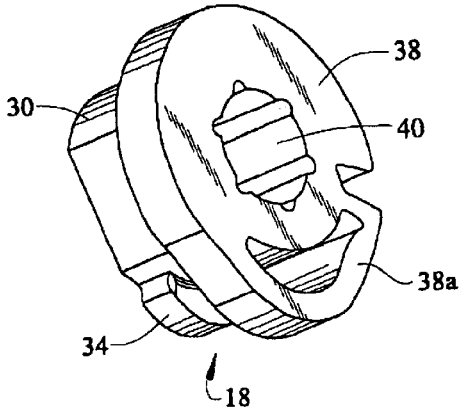
FIG. 5 is a perspective view of the bearing of this invention from the outside of the developer cartridge when installed

The outer body 38 of bearing 19 is generally circular, but has an extended part 38*a* (FIG. 5) to facilitate contact to an electrical contact pad 39 (FIG. 7). Finally, bearing 18 has a central hole 40 to receive shaft end 5*a*. Hole 40 is substantially equal in size to shaft end 5*a* Hole 40 has narrow channels 42 to collect wear debris and contamination from toner and paper dust, as is conventional. FIG. 5 and FIG. 7 show bearing 18 viewed toward the side outside of cartridge 10 when installed. Extended part 38*a* presses against electrical contact pad 39 and thereby forms an electrical connection between pad and shaft. 1

To install bearing 18, the end 5*a* of shaft 1 is first inserted in hole 40. Bearing 18 is then turned until the flat dimension 32 of bearing 18 faces gap 24 with the nub 34 is positioned away from hole 22. Since dimension 32 fits within gap 24, bearing 18 can be moved into hole 22. When that is done, bearing 18 is then rotated to bring nub 34 into cavity 26 (counterclockwise as viewed from the FIG. 3 perspective). Wall 36 contacts the lower edge of hole 22 to define when the rotation is complete, which is when nub 34 occupies substantially all of cavity 26. Bearing 18 installed is shown from the inside of cartridge 10 without roller body 2 in FIG. 2 and is shown from the outside with the entire roller of shaft 1 and roller body 2 in FIG. 7.

The side of cartridge 10 having bearing 16 carries the gear mounting plate 52. Plate 52 is a rigid plastic and firmly mounted to wall 14*b*, as by at least one screw 53 (FIG. 8). Therefore, plate 52 is much more rigid than opposite wall 14*a*. For that reason bearing 16 in this embodiment is a standard bearing having nothing corresponding to nub 34 fitting in a cavity in the frame. Bearing 16 is a cylindrical structure integral with plate 52 with inner hole that receives shaft end 5*b* surrounded by an outer surface against which ledge 3*b* abuts. Bearing plate 52, which includes bearing 16, is 30 percent glass filled Nylon 6/6 with 15 percent polytetrafluoroethylene.

FIG. 8 illustrates gear 52 mounted on shaft 1 where it extends past the frame of cartridge 10, as well as other gears forming a gear assembly in this embodiment Gear 54 receives a driving from the device (not shown) in which the cartridge 10 is mounted. Such force is transmitted through gear 56 to gear 52. Gears 52, 50 and 54 are helical gears. As the gear assembly shown is quite compact and requires a relatively strong drive force on element 54, gear 52 can not be held by a press fit. Instead, gear 52 is positively attached by a tab member 52*a* integral with gear 52. Tab member 52*a* presses by its natural resilience into notch 1*a* of shaft 1 (also FIG. 2). This invention prevents gear 52 from being displaced from the position of FIG. 8 because no element of the frame of cartridge 10 can contact gear 52.

Alternatively, bearing 16 may be a separate member having flats to form a narrow dimension as discussed in connection with bearing 18. and installed through a gap in the manner of bearing 18. Such a flat dimension and installation through a gap is known. As another alternative, bearing 16 could be a mirror image version of bearing 18 (expect without extension 38*a* as unnecessary), with plate 52 or other frame member having a cavity corresponding to cavity 26.

In accordance with this invention, forces impacting cartridge 10 rightward as viewed by the drawings will tend to force roller body 2 into wall 14*a*. Instead, however, ledge 3*a* in shaft 1 contacts bearing 18, which moves as part of the frame. Bearing 18 moves with wall 14*a* by force from nub 34 abutting wall 14*aa* of cavity 26. Roller body 2 necessarily remains spaced from contact with any frame element or the like. Also, shaft 1 is prevented by wall 14*a* from moving enough to displace gear 52.

A wide variety of alternative structures can carry out this invention so long as they provide an abutment that requires the bearing to move laterally with lateralmovement of the frame and a ledge on the shaft abutting the bearing.

What is claimed is:

1. An assembly to support a roller having a roller body and a support shaft comprising:

a frame having a partially circular hole having an open side said hole having a first diameter where said hole has opposite sides, said frame having a cavity having a open side facing said hole and an open side facing said open side of said hole and an outer wall contiguous to said hole;

a first bearing held in said hole, said first bearing having a partially circular center portion of diameter substantially the same as said first diameter, said first bearing having an outer nub extending past said diameter of said central portion, said nub being positioned in said cavity so as to abut said outer wall contiguous to said hole when moved in the direction of said hole; and a supporting shaft carrying a roller body disposed around said supporting shaft, said supporting shaft having a first end portion held for rotation on said first bearing and a first ledge, said first ledge being located to abut said first bearing, said supporting shaft having a second end portion held for rotation is a second bearing opposite said first end portion and a second ledge, said second ledge being located to abut said second bearing.

2. The assembly as in claim 1 in which said first bearing is electrically conductive and has an extended part for contacting an electrical contact member.

3. The assembly as in claim 2 in which said first bearing has a wall extending across said center portion of said first bearing to locate said nub in said cavity.

4. The assembly as in claim 3 in which said first bearing has sides forming a portion narrower than said first dimension which fits in said opening of said frame to permit insertion of said first bearing in said frame and said nub is located generally between said sides of said portion narrower than said first dimension.

5. The assembly as in claim 3 in which said supporting shaft has a part extending past said frame and a gear is mounted to and positively attached to said part extending past said frame.

6. The assembly as in claim 2 in which said first bearing has sides forming a portion narrower than said first dimension which fits in said opening of said frame to permit insertion of said first bearing in said frame and said nub is located generally between said sides of said portion narrower than said first dimension.

7. The assembly as in claim 2 in which said supporting shaft has a part extending past said frame and a gear is mounted to and positively attached to said part extending past said frame.

8. The assembly as in claim 1 in which said first bearing has a wall extending across said center portion of said first bearing to locate said nub in said cavity.

9. The assembly as in claim 8 in which said first bearing has sides forming a portion narrower than said first dimension which fits in said opening of said frame to permit insertion of said first bearing in said frame and said nub is located generally between said sides of said portion narrower than said first dimension.

10. The assembly as in claim 8 in which said supporting shaft has a part extending past said frame and a gear is mounted to and positively attached to said part extending past said frame.

11. The assembly as in claim 1 in which said first bearing has sides forming a portion narrower than said first dimension which fits in said opening of said frame to permit insertion of said first bearing in said frame and said nub is located generally between said sides of said portion narrower than said first dimension.

12. The assembly as in claim 11 in which said supporting shaft has a part extending past said frame and a gear is mounted to and positively attached to said part extending past said frame.

13. The assembly as in claim 1 in which said supporting shaft has a part extending past said frame and a gear is mounted to and positively attached to said part extending past said frame.

* * * * *